US008182057B2

(12) United States Patent
Ozawa et al.

(10) Patent No.: US 8,182,057 B2
(45) Date of Patent: May 22, 2012

(54) LIQUID EJECTING APPARATUS AND METHOD CONTROLLING LIQUID EJECTING APPARATUS

(75) Inventors: Kinya Ozawa, Shiojiri (JP); Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 298 days.

(21) Appl. No.: 12/695,041

(22) Filed: Jan. 27, 2010

(65) Prior Publication Data

US 2010/0188451 A1 Jul. 29, 2010

(30) Foreign Application Priority Data

Jan. 29, 2009 (JP) ..... 2009-017486

(51) Int. Cl.
*B41J 29/38* (2006.01)

(52) U.S. Cl. ..... 347/11

(58) Field of Classification Search ..... 347/9–11
See application file for complete search history.

(56) References Cited

U.S. PATENT DOCUMENTS

| | | | | |
|---|---|---|---|---|
| 6,793,324 | B2 * | 9/2004 | Hosono et al. | 347/54 |
| 2005/0237350 | A1 * | 10/2005 | Aoki | 347/9 |
| 2005/0270317 | A1 * | 12/2005 | Gao et al. | 347/8 |
| 2006/0279595 | A1 * | 12/2006 | Hoshiyama et al. | 347/14 |
| 2007/0182974 | A1 * | 8/2007 | Hoshiyama et al. | 358/1.8 |
| 2008/0018685 | A1 * | 1/2008 | Tabata et al. | 347/11 |
| 2008/0036807 | A1 | 2/2008 | Ihara | |
| 2008/0100652 | A1 * | 5/2008 | Oshima et al. | 347/10 |
| 2008/0106558 | A1 * | 5/2008 | Azami | 347/11 |

FOREIGN PATENT DOCUMENTS

| | | | | |
|---|---|---|---|---|
| CN | 101121317 A | | 2/2008 | |
| JP | 3412682 B2 | | 6/2003 | |
| WO | WO-2007066703 | * | 6/2007 | 347/11 |
| WO | WO-2008062809 | * | 5/2008 | 347/11 |

* cited by examiner

*Primary Examiner* — Julian Huffman
(74) *Attorney, Agent, or Firm* — Kilpatrick Townsend & Stockton LLP

(57) ABSTRACT

A liquid ejecting apparatus includes: a liquid ejecting head which includes nozzles, pressure generating chambers communicating with the nozzles, and pressure generating elements causing a pressure change in a liquid of the pressure generating chambers and which ejects the liquid from the nozzles in response to an operation of the pressure generating elements; and a driving signal generating unit which drives the pressure generating elements to repeatedly generate a driving signal containing an ejection driving pulse used to eject the liquid from the nozzles. The ejection driving pulse has a pulse waveform containing a first pressure generating chamber expansion component which expands the pressure generating chamber to draw a meniscus toward the pressure generating chamber side, a pressure generating chamber contraction component which contracts the pressure generating chamber expanded by the first pressure generating chamber expansion component to push the meniscus toward the liquid ejection side, and a second pressure generating chamber expansion component which expands the pressure generating chamber contracted by the pressure generating chamber contraction component to draw the meniscus toward the pressure generating chamber side again. Each of the pressure generating chamber expansion components has a plurality of different potential change ratios.

7 Claims, 7 Drawing Sheets

LIQUID EJECTING APPARATUS AND METHOD CONTROLLING LIQUID EJECTING APPARATUS

BACKGROUND

1. Technical Field

The present invention relates to a liquid ejecting apparatus such as an ink jet printer and a method of controlling the liquid ejecting apparatus, and in particular, to a liquid ejecting apparatus capable of controlling ejection of a liquid by applying a driving pulse contained in a driving signal to a pressure generating element and a method of controlling the liquid ejecting apparatus.

2. Related Art

A liquid ejecting apparatus is an apparatus which includes a liquid ejecting head capable of ejecting a liquid and ejects a variety of liquids from the liquid ejecting head. The representative example of the liquid ejecting apparatus is an image printing apparatus, such as an ink jet printer (hereinafter, simply referred to as a printer) which includes an ink jet printing head (hereinafter, simply referred to as a printing head) serving as a liquid ejecting head and prints an image or the like by ejecting and landing liquid-like ink onto a print medium (landing target) such as a print sheet from nozzles of the printing head. In recent years, the liquid ejecting apparatus has been applied to a variety of manufacturing apparatuses such as an apparatus manufacturing a color filter such as a liquid crystal display, as well as the image printing apparatus.

A liquid ejecting apparatus is configured so as to eject a liquid from nozzles communicating with pressure generating chambers by applying an ejection driving pulse to pressure generating elements (for example, piezoelectric vibrators or heating elements), driving the pressure generating elements, changing the pressure of the liquid in the pressure generating chambers, and using this change in the pressure. In a printer disclosed in Japanese Patent No. 3412682, for example, a driving pulse (driving waveform) is used which includes an expansion step of preparing to draw a meniscus of a nozzle toward the pressure generating chamber side to the utmost, a hold step of holding this expanded state to adjust ejection time of an ink droplet, a first contraction step of ejecting the ink droplet by the contraction of the pressure generating chamber, and a second contraction step of reducing the drawing of the meniscus by reaction of the ejection operation. That is, the ink droplet is configured to be ejected by drawing the meniscus in the expansion step, contracting the pressure generating chamber, and using the reaction to the drawing of the meniscus.

However, in the foregoing known driving pulse for expanding and contracting the pressure generating chamber to eject the ink, it is difficult to eject minute liquid droplets, when a liquid (hereinafter, referred to as a high-viscosity liquid) of which a viscosity is higher than that of a liquid such as ink used in a known household ink jet printer is used.

FIGS. 8A to 8C are schematic views illustrating the movement of a meniscus of a nozzle in an operation of ejecting the high-viscosity liquid by the known driving pulse. The upper side of the drawings is the pressure generating chamber side and the lower side of the drawings is the liquid ejection side. In FIG. 8A, when the meniscus is drawn quickly toward the pressure generating chamber side in the expansion step, the central portion of the meniscus, which receives less of an influence of the inner circumferential surface of the nozzle, moves at a fast speed toward the pressure generating chamber side. However, since the portion of the meniscus closer to the inner circumferential surface of the nozzle is drawn to the inner circumferential surface of the nozzle due to the influence of the viscosity and scarcely follows the pressure change, the meniscus moves at a slow speed (hereinafter, this portion is referred to as a boundary layer). For this reason, in the known expansion step, the entire expanded meniscus cannot be drawn. In order to make the ejected ink droplet minute, it is necessary to largely draw the entire meniscus including the boundary layer, to push the central portion of the meniscus toward the liquid ejection side by reaction to the drawing, and to separate and eject only the central portion of the meniscus. However, in a case where the entire expanded meniscus cannot be drawn, the central portion of the meniscus is extruded together with the boundary layer when the central portion of the meniscus is pushed outward, as in FIG. 8B. Therefore, the ejected ink droplet becomes large.

In the high-viscosity ink, as shown in FIG. 8C, the rear portion of the ink ejected from the nozzle easily grows into a tail-like portion (drawn tail), when the ink is ejected from the nozzle. Moreover, a problem may arise in that the tail-like portion is separated from the main portion of the ink droplet and is not landed on the regular position (desirable position) of a landing target. In the ink jet printer, for example, the tail-like portion may become mist and be landed out of the regular location, so that a dot is separated. Therefore, a problem may arise in that an image quality deteriorates. In particular, in the high-viscosity liquid, since the tail-like portion is separated into several pieces, the several separated pieces (satellite ink droplets or mist) may result in deteriorating the image quality to a great extent.

SUMMARY

An advantage of some aspects of the invention is that it provides a liquid ejecting apparatus capable of making a liquid droplet minute and preventing a mist or the like upon ejecting a high-viscosity liquid to prevent a dot from being separated and a method of controlling the liquid ejecting apparatus.

According to an aspect of the invention, there is provided a liquid ejecting apparatus including: a liquid ejecting head which includes nozzles, pressure generating chambers communicating with the nozzles, and pressure generating elements causing a pressure change in a liquid of the pressure generating chambers and which ejects the liquid from the nozzles in response to an operation of the pressure generating elements; and a driving signal generating unit which drives the pressure generating elements to repeatedly generate a driving signal containing an ejection driving pulse used to eject the liquid from the nozzles. The ejection driving pulse has a pulse waveform containing a first pressure generating chamber expansion component which expands the pressure generating chamber to draw a meniscus toward the pressure generating chamber side, a pressure generating chamber contraction component which contracts the pressure generating chamber expanded by the first pressure generating chamber expansion component to push the meniscus toward the liquid ejection side, and a second pressure generating chamber expansion component which expands the pressure generating chamber contracted by the pressure generating chamber contraction component to draw the meniscus toward the pressure generating chamber side again. Each of the pressure generating chamber expansion components has a plurality of different potential change ratios.

Here, "the potential change ratio" refers to a change degree of the potential in unit time.

In the liquid ejecting apparatus according to the aspect of the invention, the first pressure generating chamber expansion component may include at least a first fast expansion component in which a potential is changed at a first change ratio and a first slow expansion component which occurs before the first fast expansion component and in which the potential is changed at a second change ratio smaller than the first change ratio.

With such a configuration, since the first slow expansion component changing the potential more slowly occurs before the first fast expansion component, it is possible to make the ejected liquid droplet minute. That is, by drawing the meniscus toward the pressure generating chamber side relatively slowly by the first slow expansion component, the meniscus on the inner circumferential surface of the nozzle which scarcely follows the pressure change can be made to follow the central portion of the meniscus which easily follows the pressure change. Thereafter, by drawing the meniscus fast by the first fast expansion component, expanding the pressure generating chamber, and then pushing the central portion of the meniscus, it is possible to eject the central portion of the meniscus as the minute liquid droplet.

In the liquid ejecting apparatus according to the aspect of the invention, the second pressure generating chamber expansion component may include at least a second fast expansion component in which a potential is changed at a third change ratio and a second slow expansion component which occurs after the second fast expansion component and in which the potential is changed at a fourth change ratio smaller than the third change ratio.

In the liquid ejecting apparatus according to the aspect of the invention, the second pressure generating chamber expansion component may include an expansion hold component, which holds the expanded state of the pressure generating chamber expanded by the second fast expansion component during a certain period, between the second fast expansion component and the second slow expansion component. The expansion hold component may hold the expanded state of the pressure generating chamber, until a movement direction of the meniscus on the inner circumferential surface of the nozzle is reversed from the pressure generating chamber side to the liquid ejection side after the expansion of the pressure generating chamber by the second fast expansion component.

With such a configuration, since the periphery of the central portion (columnar portion) of the meniscus swollen toward the liquid ejection side by the pressure generating chamber contraction component is fast drawn by expanding the pressure generating chamber at the relatively fast speed by the second fast expansion component, it is possible to make the columnar portion small. Thereafter, by expanding the pressure generating chamber at the relatively slow speed by the second slow expansion component, it is possible to prevent the columnar portion from growing excessively. In this way, it is possible to make the liquid droplet minute and prevent the liquid droplet from becoming a drawn tail.

According to the aspect of the invention, even when a high-viscosity liquid is used in comparison to the known ink, the ink droplets can be made minute. Moreover, since the liquid droplets are prevented from becoming a drawn tail, a dot can be prevented from being separated.

According to another aspect of the invention, there is provided a method of controlling a liquid ejecting apparatus including a liquid ejecting head which includes nozzles, pressure generating chambers communicating with the nozzles, and pressure generating elements causing a pressure change in a liquid of the pressure generating chambers and which ejects the liquid from the nozzles in response to an operation of the pressure generating elements and a driving signal generating unit which drives the pressure generating elements to repeatedly generate a driving signal containing an ejection driving pulse used to eject the liquid from the nozzles. The method includes an ejection process executed by applying the ejection driving pulse to the pressure generating element. The ejection process includes a first pressure generating chamber expansion step of expanding the pressure generating chamber to draw a meniscus toward the pressure generating chamber side, a pressure generating chamber contraction step of contracting the pressure generating chamber to push the meniscus toward the liquid ejection side, and a second pressure generating chamber expansion step of expanding the pressure generating chamber to draw the meniscus toward the pressure generating chamber side again. In each of the pressure generating chamber expansion steps, an expansion ratio is changed during the expansion.

In the method according to the aspect of the invention, in the first pressure generating chamber expansion step, an expansion speed of a first slow expansion step executed earlier may be smaller than an expansion speed of a first fast expansion step executed later.

In the method according to the aspect of the invention, in the second pressure generating chamber expansion step, an expansion speed of a second fast expansion step executed earlier may be larger than an expansion speed of a second slow expansion step executed later.

According to the aspect of the invention, in the first pressure generating chamber expansion step, the boundary layer can be drawn while permitting the boundary layer of the meniscus to follow the central portion, by expanding the pressure generating chamber at the relatively slow speed initially. Thereafter, the entire meniscus can be drawn largely by expanding the pressure generating chamber at the relatively fast speed. In the second pressure generating chamber expansion step, by expanding the pressure generating chamber at the relatively fast speed, the periphery of the columnar portion swollen toward the liquid ejection side is drawn fast in the pressure generating chamber contraction step and the columnar portion can be made small. Thereafter, by expanding the pressure generating chamber again at the relatively slow speed, the columnar portion can be prevented from growing excessively. As a consequence, even when the high-viscosity liquid is used in comparison to the known ink, the liquid droplets can be made minute. Moreover, since the liquid droplets are prevented from becoming a drawn tail, a dot can be prevented from being separated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the accompanying drawings. The embodiment described below limits the invention to various forms, but the scope of the invention is not limited to the various forms by the following description, as long as the details limiting the invention are not particularly described. In addition, an ink jet printing apparatus (hereinafter, referred to as a printer) according to the invention will be described below as an example of a liquid ejecting apparatus.

Figure 1:
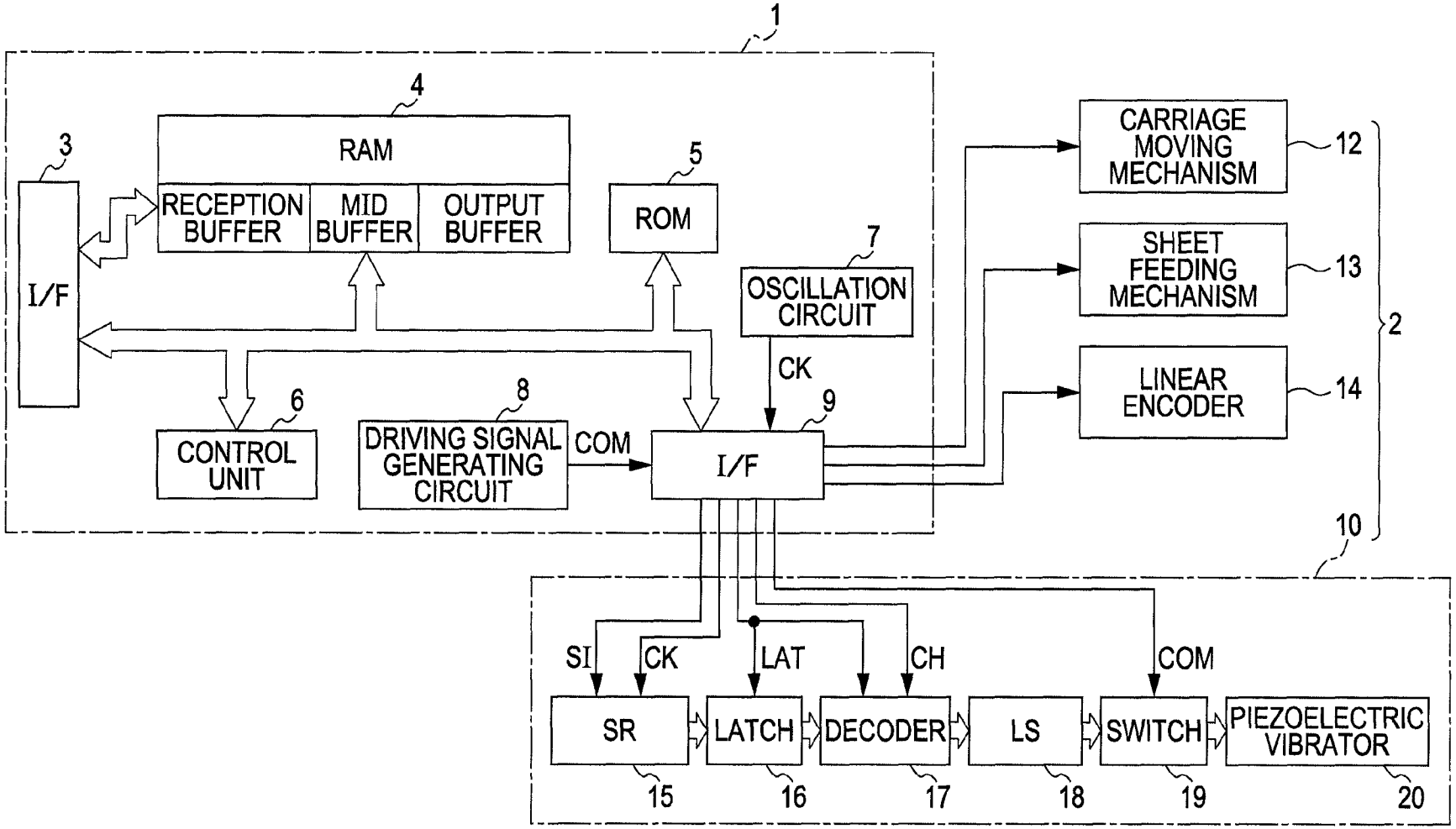
FIG. 1 is a block diagram illustrating the electrical configuration of a printer.

FIG. 1 is a block diagram illustrating the electrical configuration of the printer. The printer includes a printer controller 1 and a print engine 2 as a whole. The printer controller 1 includes an external interface (external I/F) 3 which transmits and receives data to and from an external apparatus such as a host computer, a RAM 4 which stores a variety of data, a ROM 5 which stores a control routine or the like used to process the variety of data, a control unit 6 which controls each unit, an oscillation circuit 7 which generates a clock signal, a driving signal generating circuit 8 which generates a driving signal to be supplied to a printing head 10, and an internal interface (internal I/F) 9 which outputs dot pattern data, the driving signal, or the like to the printing head 10.

The control unit 6 controls each unit and also converts print data received from the external apparatus through the external I/F 3 into dot pattern data to output the dot pattern data to the printing head 10 through the internal I/F 9. The dot pattern data is constituted by print data obtainable by decoding (translating) gray scale data. The control unit 6 supplies a latch signal, a channel signal, or the like to the printing head 10 on the basis of the clock signal from the oscillation circuit 7. A latch pulse or a channel pulse contained in the latch signal or the channel signal defines supply time of each pulse constituting the driving signal.

The driving signal generating circuit 8 generates a driving signal used to drive a piezoelectric vibrator 20 under the control of the control unit 6. The driving signal generating circuit 8 according to this embodiment is configured to generate a driving signal COM which includes: an ejection pulse used to eject an ink droplet (which is a kind of liquid droplet) and form a dot on a print sheet (which is a kind of landing target); or a minute vibration pulse used to minutely vibrate a free surface of ink (which is a kind of liquid), that is, a meniscus exposed to a nozzle 37 (see FIG. 2) and agitate ink within one print period.

Next, the configuration of the print engine 2 will be described. The print engine 2 includes the printing head 10, a carriage moving mechanism 12, a sheet feeding mechanism 13, and a linear encoder 14. The printing head 10 includes a shift register (SR) 15, a latch 16, a decoder 17, a level shifter (LS) 18, a switch 19, and piezoelectric vibrators 20. The dot pattern data SI from the printer controller 1 is transmitted serially to the shift register 15 in synchronization with the clock signal (CK) from the oscillation circuit 7. The dot pattern data is 2-bit data and organized by gray scale information indicating print gray scale (ejection gray scale) of four gray scales, such as non-print (minute vibration), a small dot, a middle dot, and a large dot. Specifically, the non-print is expressed by gray scale information "00", the small dot is expressed by gray scale information "01", the middle dot is expressed by gray scale information "10", and the large dot is expressed by gray scale information "11".

The latch 16 is electrically connected to the shift register 15. Therefore, when a latch signal (LAT) is input from the printer controller 1 to the latch 16, the dot pattern data of the shift register 15 is latched. The dot pattern data latched by the latch 16 is input to the decoder 17. The decoder 17 translates the 2-bit dot pattern data and generates pulse selection data. The pulse selection data is formed by making each bit correspond to each pulse forming the driving signal COM. In addition, the ejection pulse is supplied or not supplied to the piezoelectric vibrators 20 depending on the contents of each bit, for example, "0" or "1".

The decoder 17 outputs the pulse selection data to the level shifter 18 when receiving the latch signal (LAT) or the channel signal (CH). In this case, the pulse selection data is input to the level shifter 18 in order from a higher-order bit. The level shifter 18 serves as a voltage amplifier. When the bit of the pulse selection data is "1", a voltage driving the switch 19, for example, an electric signal boosted by about several tens of voltage is output. The pulse selection data with the bit of "1" which is boosted by the level shifter 18 is supplied to the switch 19. The driving signal COM from the driving signal generating circuit 8 is supplied to an input portion of the switch 19 and the piezoelectric vibrators 20 are connected to the output portion of the switch 19.

The pulse selection data is used to control the operation of the switch 19, that is, the supply of the driving pulse of the driving signal to the piezoelectric vibrators 20. For example, while the bit of the pulse selection data input to the switch 19 is "1", the switch 19 becomes a connection state. At this time, the corresponding ejection pulse is supplied to the piezoelectric vibrators 20, and the potential level of the piezoelectric vibrators 20 is changed in accordance with the waveform of the ejection pulse. On the other hand, while the bit of the pulse selection data input to the switch 19 is "0", no electric signal used to operate the switch 19 is output from the level shifter 18. Therefore, the switch 19 becomes a disconnection state, and thus no ejection pulse is supplied to the piezoelectric vibrators 20.

The decoder 17, the level shifter 18, the switch 19, the control unit 6, and the driving signal generating circuit 8 executing these operations serve as an ejection controlling unit according to the invention, and select the necessary ejection pulse from the driving signal to apply (supply) the selected ejection pulse to the piezoelectric vibrators 20. As a consequence, the piezoelectric vibrators 20 are expanded or contracted. A pressure generating chamber 35 (see FIG. 2) is expanded or contracted in response to the expansion and the contraction of the piezoelectric vibrators 20, and thus ink droplets of an amount corresponding to the gray scale information constituting the dot pattern data are ejected from the nozzle.

Figure 2:
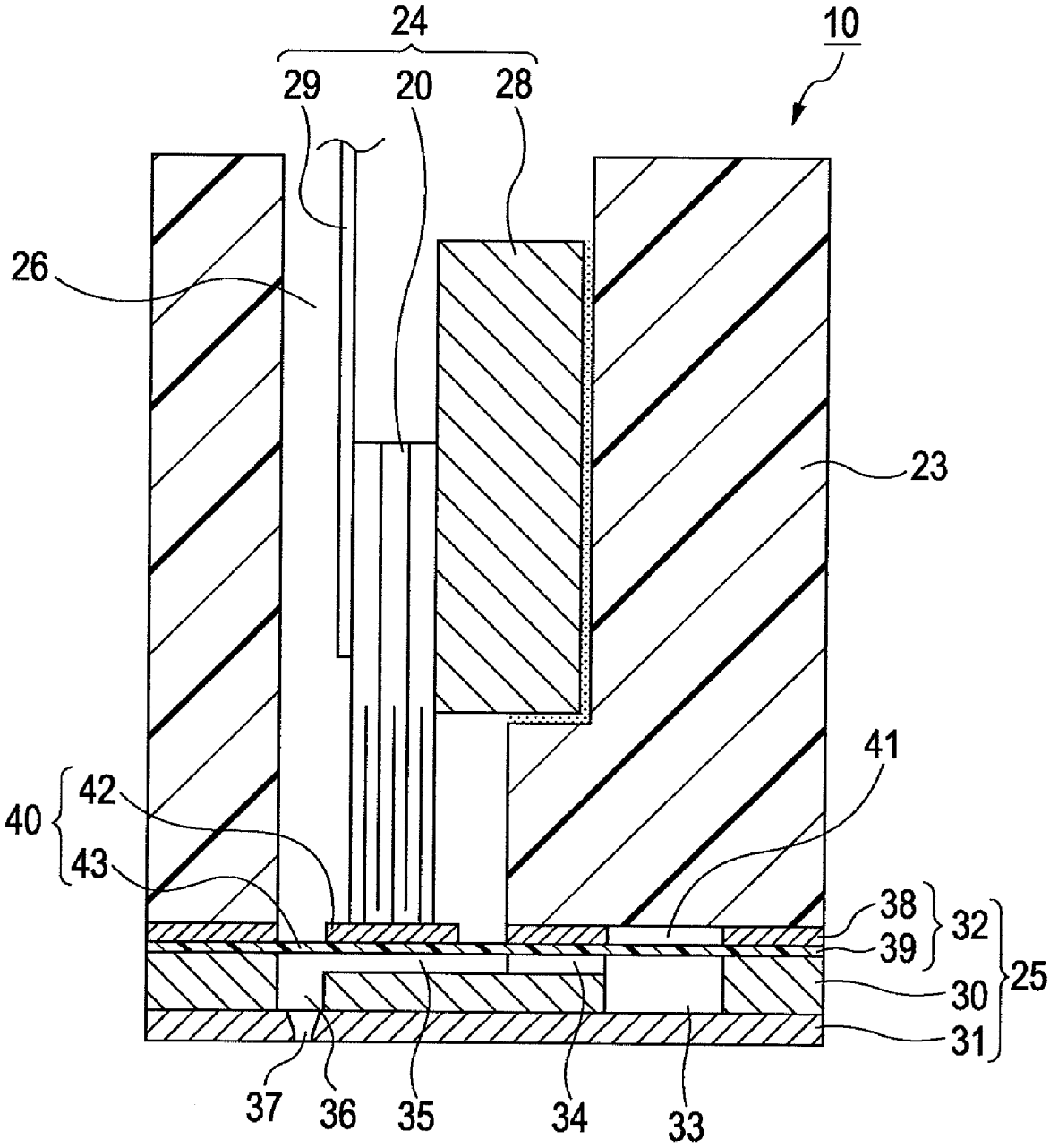
FIG. 2 is a sectional view illustrating the configuration of main elements of a printing head.
Figure 3:
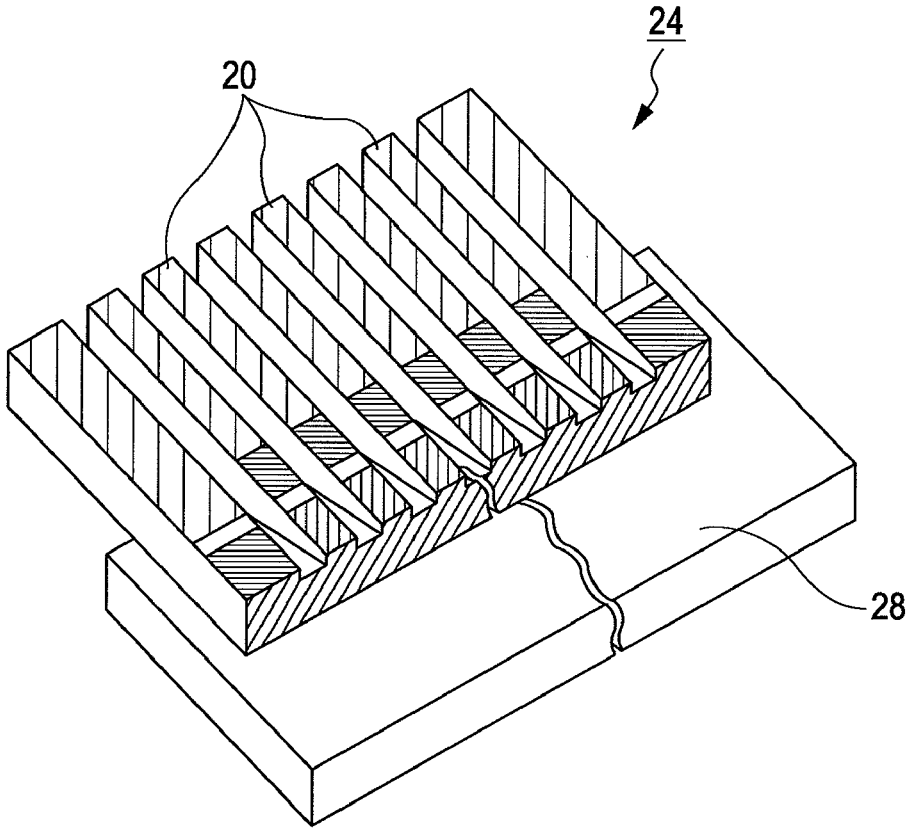
FIG. 3 is a perspective view illustrating the configuration of a vibrator unit.

FIG. 2 is a sectional view illustrating the configuration of main elements of the printing head 10 (which is a kind of liquid ejecting head). The printing head 10 includes a case 23, a vibrator unit 24 accommodated in the case 23, and a passage unit 25 joined onto the bottom surface (front end surface) of the case 23. The case 23 is made of epoxy-based resin, for example. An accommodation hollow section 26 accommodating the vibrator unit 24 is formed inside the case 23. The vibrator unit 24 includes the piezoelectric vibrators 20 serving as a kind of pressure generating element, a fixing plate 28 to which the piezoelectric vibrators 20 are joined, and a flexible cable 29 supplying a driving signal to the fixing plate 28 and each piezoelectric vibrator 20. As shown in FIG. 3, the piezoelectric vibrator 20 is a longitudinal vibration mode piezoelectric vibrator which is formed such that a piezoelectric plate, where piezoelectric layers and electrode layers are alternately laminated, is separated in a pectinate shape and which is expandable and contractible (a transverse effect of an electric field) in a direction perpendicular to a lamination direction (electric field direction).

The passage unit 25 is formed such that a nozzle plate 31 is joined onto one surface of a passage forming board 30 and a vibration plate 32 is joined onto the other surface of the passage forming board 30. The passage unit 25 includes a reservoir 33 (common liquid chamber), ink supply ports 34, pressure generating chambers 35, nozzle communication ports 36, and nozzles 37. A series of ink passages formed from the ink supply port 34 to the nozzle 37 via the pressure generating chamber 35 and the nozzle communication port 36 is formed so as to correspond to each nozzle 37.

The nozzle plate 31 is a thin plate which is made of metal such as stainless steel and is formed such that the plurality of nozzles 37 is punched in rows at a pitch (for example, 360 dpi) corresponding to a dot formation density. In the nozzle plate 31, a plurality of nozzle rows (nozzle group) of the nozzles 37 is formed and one nozzle row is constituted by 360 nozzles 37, for example.

The vibration plate 32 has a double structure in which an elastic film 39 is laminated on a surface of a supporting plate 38. In this embodiment, the vibration plate 32 is formed by using a stainless steel plate, which is a kind of metal plate, as the supporting plate 38 and using a composite plate formed by laminating a resin film as the elastic film 39 on the surface of the supporting plate 38. A diaphragm 40 changing the volume of the pressure generating chamber 35 is disposed in the vibration plate 32. A compliance section 41 sealing a part of the reservoir 33 is disposed in the vibration plate 32.

The diaphragm 40 is formed by partially removing the supporting plate 38 by etching. That is, the diaphragm 40 includes: an island section 42 to which the front end surface of the free end of each piezoelectric vibrator 20 is joined; and a thin-walled elastic section 43 surrounding the island section 42. The compliance section 41 is formed by removing the supporting plate 38 in an area facing the passage surface of the reservoir 33 by etching, like the diaphragm 40. The compliance section 41 functions as a damper absorbing the pressure change in the liquid stored in the reservoir 33.

Since the piezoelectric vibrators 20 are joined to the front end surface of the island section 42, it is possible to change the volume of the pressure generating chamber 35 by expanding and contracting the free end of the piezoelectric vibrator 20. The pressure of the ink in the pressure generating chamber 35 is changed with the change in the volume. The printing head 10 is configured to eject ink droplets from the nozzles 37 by using this pressure change.

Figure 4:
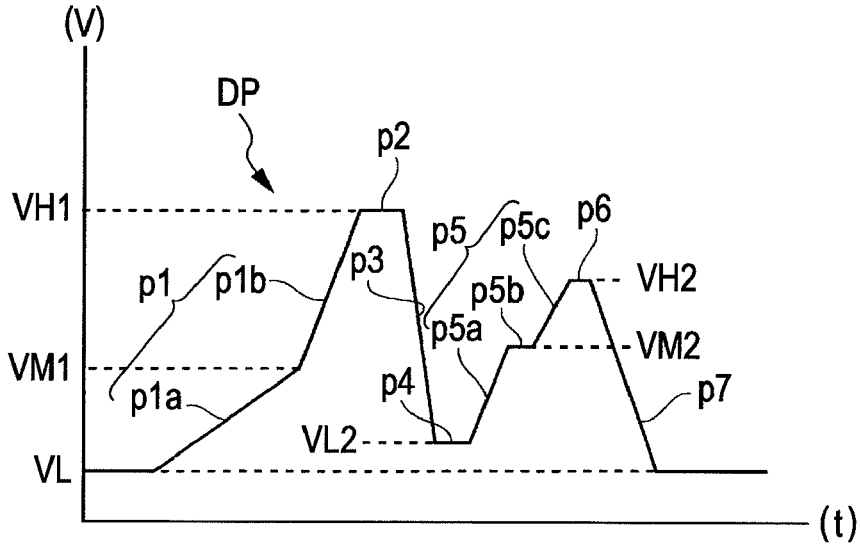
FIG. 4 is an explanatory diagram illustrating a waveform of an ejection driving pulse.

FIG. 4 is an explanatory diagram illustrating the configuration of a waveform of an ejection driving pulse DP contained in the driving signal COM generated by the driving signal generating circuit 8 having the above-described configuration. The exemplified ejection driving pulse DP is an ejection driving pulse (small dot ejection driving pulse) used to eject an ink droplet with the smallest size among the ink droplets which can be ejected from the printer according to this embodiment. The ejection driving pulse DP includes: a first pressure generating chamber expansion component p1 increasing potential from a reference potential VL to a first expansion potential VH1 to expand the volume of the pressure generating chamber 35 from a reference volume to the maximum expansion volume; a first hold component p2 holding the expanded state of the pressure generating chamber 35 for a certain period and is constant at the first expansion potential VH1; a first contraction component p3 (pressure generating chamber contraction component) decreasing the potential from the first expansion potential VH1 to a contraction potential VL2 at a constant slope to contract the pressure generating chamber 35; a second hold component p4 holding the contracted state of the pressure generating chamber 35 and being constant at the contraction potential VL2; a second pressure generating chamber expansion component p5 increasing the potential from the contraction potential VL2 to a second expansion potential VH2 to expand the pressure generating chamber 35; a third hold component p6 holding the expanded state of the pressure generating chamber 35 for a certain period and being constant at the second expansion potential VH2; and a second contraction component p7 decreasing the potential from the second expansion potential VH2 to the reference potential VL at a constant slope to contract the pressure generating chamber 35 and return the volume of the pressure generating chamber 35 to the reference volume.

Here, the pressure generating chamber expansion components p1 and p5 in the ejection driving pulse DP each include a plurality of potential change ratios. That is, the pressure generating chamber expansion components p1 and p5 are each configured to change an expansion speed during the expansion of the pressure generating chamber.

First, the first pressure generating chamber expansion component p1 includes a first fast expansion component p1*b* changing the potential at a first change ratio (which is the same as that of the first pressure generating chamber expansion component of the known minute ink ejection driving pulse) and a first slow expansion component p1*a* occurring before the first fast expansion component p1*b* and changing the potential at a second change ratio smaller than the first change ratio. The first slow expansion component p1*a* is a waveform component increasing the potential from the reference potential VL to a first mid-potential VM1 to expand the pressure generating chamber 35 relatively slowly from the reference volume to a first mid expansion volume. The first past expansion component p1*b* is a waveform component increasing the potential from the first mid-potential VM1 to the first expansion potential VH1 to expand the pressure generating chamber 35 relatively fast from the first mid expansion volume to the maximum expansion volume.

The second pressure generating chamber expansion component p5 includes a second fast expansion component p5*a* changing the potential at a third change ratio (which is the same as or slightly larger than the first change ratio of the first fast expansion component p1*b*), a second slow expansion component p5*c* occurring next to the second fast expansion component p5*a* and changing the potential at a fourth change ratio smaller than the third change ratio, and a mid hold component p5*b* (corresponding to an expansion hold component according to the invention) occurring between the second fast expansion component p5 and the second slow expansion component p5*c*. The second fast expansion component p5*a* is a waveform component increasing the potential from the contraction potential VL2 to the second mid-potential VM2 to expand the pressure generating chamber 35 relatively fast. The mid hold component p5*b* is a waveform component which is constant at the second mid-potential VM2. The second slow expansion component p5*c* is a waveform component increasing the potential from the second mid-potential VM2 to the second expansion potential VH2 to expand the pressure generating chamber 35 relatively slowly.

Figure 5A:
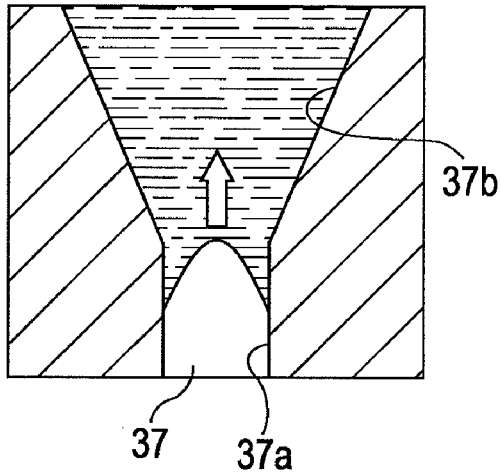
FIGS. 5A and 5C are schematic views illustrating the movement of a meniscus when an ink droplet is ejected.

When the ejection driving pulse DP is applied to the piezoelectric vibrator 20, an operation is executed as follows. First, the piezoelectric vibrator 20 is contracted by the first slow expansion component p1*a* of the first pressure generating chamber expansion component p1, so that the pressure generating chamber 35 is slowly expanded from the minimum volume corresponding to the reference potential VL to the first mid expansion volume specified by the first mid-potential VM1 (first slow expansion step). In this way, as shown in FIG. 5A, the meniscus is drawn toward the side of the pressure generating chamber 35 at a relatively slow speed. By drawing the meniscus slowly, it is possible to move the meniscus toward the pressure generating chamber side as a whole while permitting the boundary layer of the meniscus near the inner circumferential surface of the nozzle to follow the central portion of the meniscus. Moreover, an arrow shown in FIG. 5A indicates the movement of the meniscus.

Figure 5B:
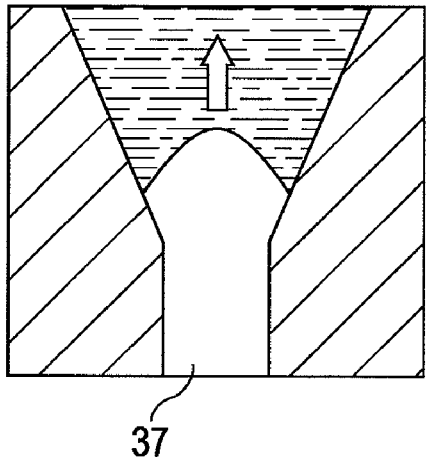
Figure 5C:
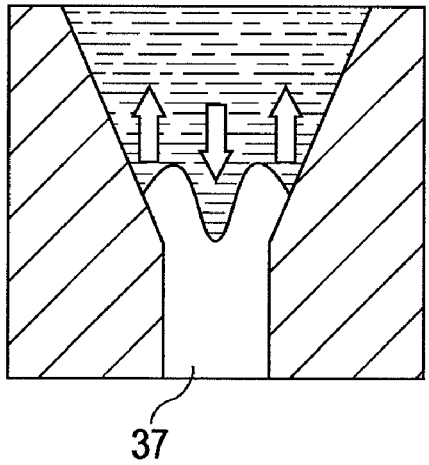

Subsequently, the first fast expansion component p1*b* of the first pressure generating chamber expansion component p1 is applied to the piezoelectric vibrator 20 at a time at which the meniscus is drawn to move over the boundary between a straight portion 37*a*, of which an inner diameter is constant, and a taper portion 37*b*, of which an inner diameter gets larger toward to the side of the pressure generating chamber 35. The piezoelectric vibrator 20 is contracted by the first fast expansion component p1*b* to expand the volume of the pressure generating chamber 35 fast from the first mid expansion volume to the maximum expansion volume to the degree that the ink is not ejected (first fast expansion step). In this way, as shown in FIG. 5B, the meniscus is drawn toward the side of the pressure generating chamber 35 at a speed faster than that of the first slow expansion step, so that the entire expanded meniscus can be drawn. The expanded state of the pressure generating chamber 35 is kept during the supply of the first hold component p2. Subsequently, by applying the first contraction component p3 to the piezoelectric vibrator 20 to expand the piezoelectric vibrator 20 fast, the volume of the pressure generating chamber 35 is contracted from the maximum expansion volume to the contraction volume corresponding to the contraction potential VL2 (a first contraction step which corresponds to a pressure generating chamber contraction step). The ink in the pressure generating chamber 35 is pressurized by the fast contraction of the pressure generating chamber 35. Accordingly, as shown in FIG. 5C, the central portion of the meniscus, which easily moves in accordance with the pressure change, is pushed outward to be swollen in a columnar shape (hereinafter, referred to as a columnar portion). Moreover, the contracted state of the pressure generating chamber 35 is kept during the supply of the second hold component p4.

Figure 6A:
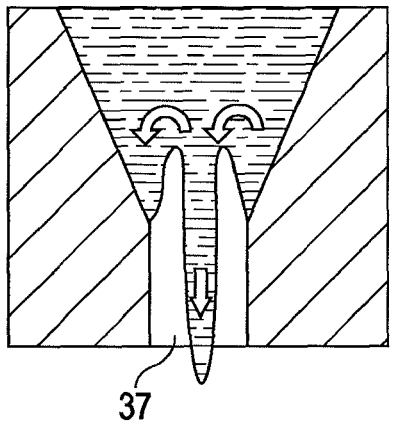
FIGS. 6A and 6C are schematic views illustrating the movement of a meniscus when an ink droplet is ejected.
Figure 6B:
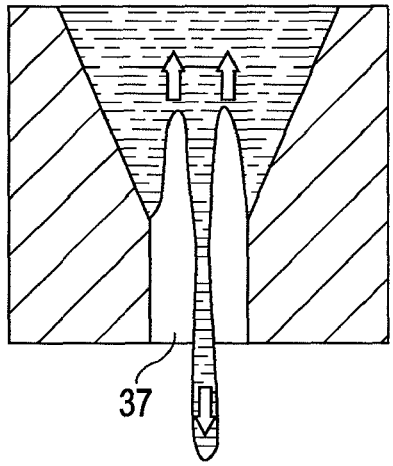

Subsequently, when the second fast expansion component p5*a* of the second pressure generating chamber expansion component p5 is applied to the piezoelectric vibrator 20, the piezoelectric vibrator 20 is contracted and the pressure generating chamber 35 is fast expanded from the contraction volume to the second mid expansion volume corresponding to the second mid-potential VM2 (second fast expansion step). In this way, the periphery of the columnar portion of the meniscus is drawn toward the side of the pressure generating chamber 35 at a relatively fast speed. On the other hand, the columnar portion continues to move toward the liquid ejection side by the inertial force generated when the central portion is pushed toward the liquid ejection side in the first contraction step. Continuously, when the mid hold component p5*b* is applied to the piezoelectric vibrator 20, the mid expansion volume is kept for a certain period. Meanwhile, as shown in FIG. 6A, the movement direction of the boundary layer of the meniscus is reversed from the side of the pressure generating chamber 35 to the liquid ejection side. At this time, when the second slow expansion component p5*c* is applied to the piezoelectric vibrator 20, the pressure generating chamber 35 is expanded again slowly from the second mid expansion volume to the second expansion volume corresponding to the second expansion potential VH2 (second slow expansion step). In this way, as shown in FIG. 6B, the periphery of the columnar portion of the meniscus is drawn toward the side of the pressure generating chamber 35 at a relatively slow speed. At this time, the columnar portion grows maximally. The expanded state of the pressure generating chamber 35 is kept during the supply of the third hold component p6.

Figure 6C:
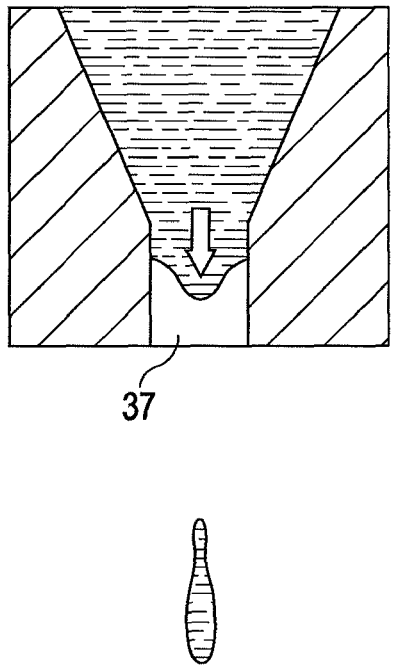

Subsequently, as shown in FIG. 6C, the columnar portion is cut and a portion separated from the meniscus is ejected from the nozzle 37 as the number p1 of minute ink droplets of which a diameter is smaller than the inner diameter of the nozzle 37. Subsequently, when the second contraction component p7 is applied to the piezoelectric vibrator 20 after the third hold component p6 at a time, at which the meniscus is drawn toward the side of the pressure generating chamber 35 by the reaction against the ejection of the ink droplets, and the piezoelectric vibrator 20 is expanded, the pressure generating chamber 35 is contracted from the second expansion volume specified by the second expansion potential VH2 to the reference volume (second contraction step). In this way, by preventing the meniscus from being drawn toward the pressure generating chamber side, the residual vibration of the meniscus is prevented. Moreover, since the meniscus approaches the ejected ink droplet, the remaining ink is absorbed into the meniscus. Accordingly, the rear end of the ejected ink droplet is prevented from growing into a tail-like shape (drawn tail).

In the first pressure generating chamber expansion component p1 (first pressure generating chamber expansion step), the boundary layer can be drawn while permitting the boundary layer of the meniscus to follow the central portion, by expanding the pressure generating chamber 35 at the relatively slow speed initially by the first slow expansion component p1*a*. Thereafter, the entire meniscus can be drawn largely by expanding the pressure generating chamber 35 at the relatively fast speed by the first fast expansion component p1*b*. In the second pressure generating chamber expansion component p5 (second pressure generating chamber expansion step), by expanding the pressure generating chamber 35 at a relatively fast speed by the second fast expansion component p5*a*, the periphery of the columnar portion swollen toward the liquid ejection side is drawn fast in the first contraction step and the columnar portion can be made small. Thereafter, by maintaining the expanded state by the mid hold component p5*b*, pending the time at which the movement direction of the boundary layer of the meniscus is reversed from the side of the pressure generating chamber 35 to the liquid ejection side, and then again expanding the pressure generating chamber 35 at the relatively slow speed by the second slow expansion component p5*c*, the columnar portion can be prevented from growing excessively. As a consequence, even when the high-viscosity ink is used in comparison to the known ink, the ink droplets can be made minute. Moreover, since the ink droplets are prevented from becoming a drawn tail, a dot can be prevented from being separated.

The invention is not limited to the above-described embodiment, but may be modified in various forms within the scope of the claims.

In the above-described embodiment, the ejection driving pulse DP shown in FIG. 4 has been described as an example of an ejection driving pulse according to the invention. However, the invention is not limited to the form of the ejection driving pulse. Any waveform may be used, as long as the ejection driving pulse is used which includes at least the first pressure generating chamber expansion component p1 for expanding the pressure generating chamber preliminarily, the first contraction component p3 (pressure generating chamber contraction component) for contracting the expanded pressure generating chamber and pushing the meniscus, and the second pressure generating chamber expansion component p5 for expanding the pressure generating chamber subsequently.

Figure 7:
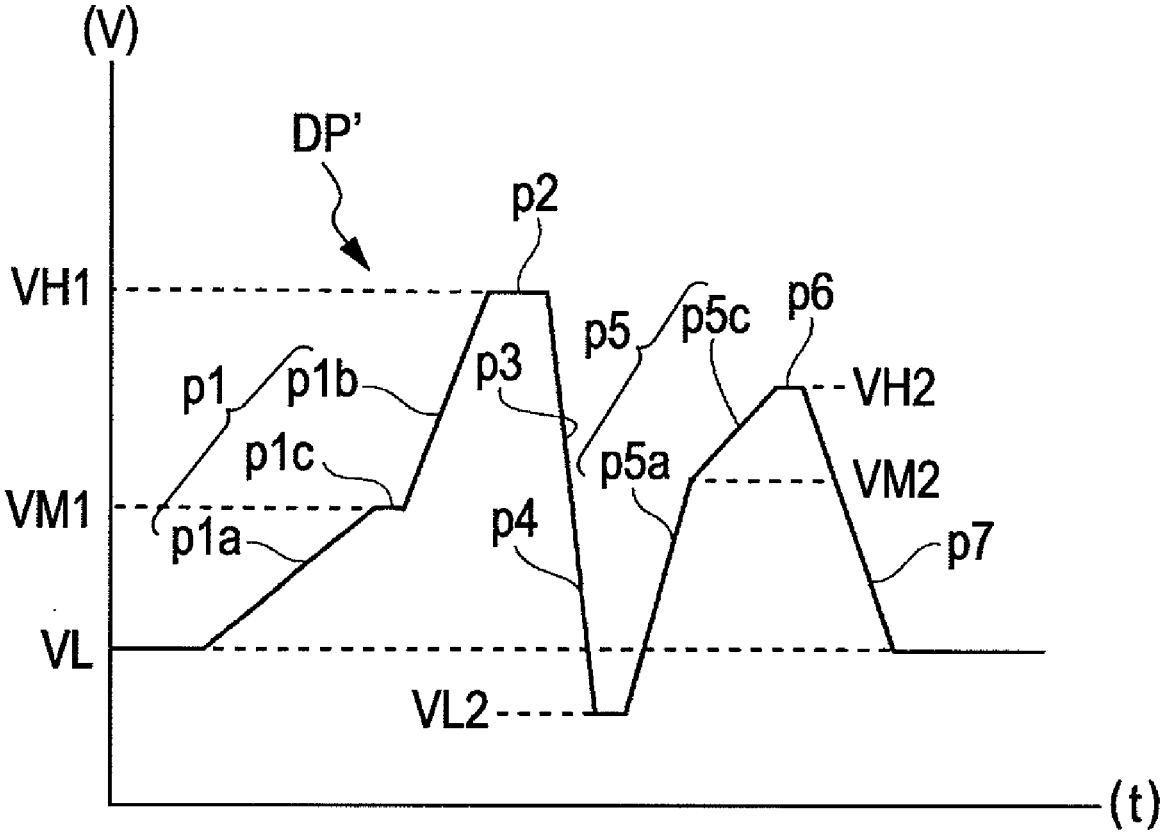
FIG. 7 is a diagram illustrating the waveform of an ejection driving pulse according to a second embodiment.
Figure 8A:
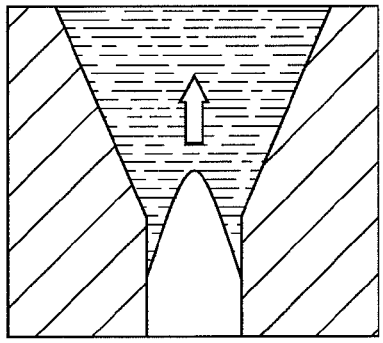
FIGS. 8A to 8C are schematic views illustrating the movement of a meniscus when an ink droplet is ejected using a known ejection driving pulse.
Figure 8B:
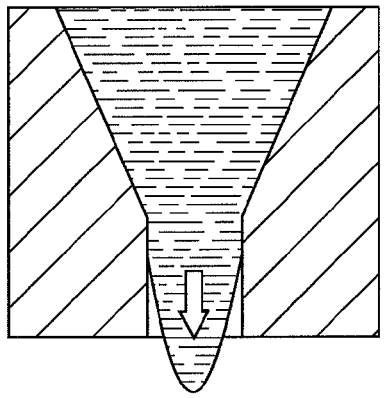
Figure 8C:
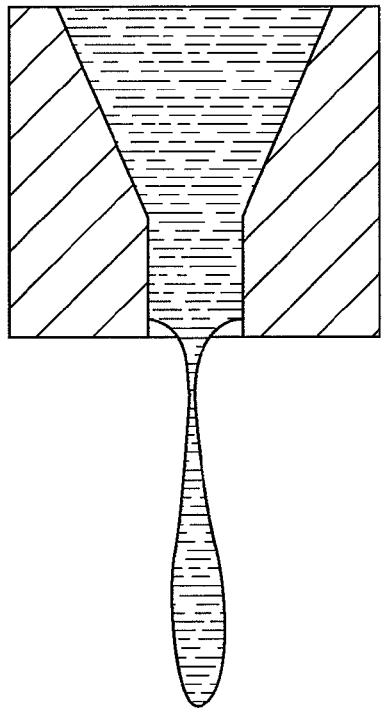

For example, FIG. 7 is a diagram illustrating the configuration of an ejection driving pulse DP' according to a second embodiment. The ejection driving pulse DP' according to the second embodiment is different from the ejection driving pulse DP according to the first embodiment in that the first pressure generating chamber expansion component p1 is provided with a mid hold component p1*c* between the first slow expansion component p1*a* and the first fast expansion component p1*b*. By providing the mid hold component p1*c*, it is possible to adjust a time at which the pressure generating chamber 35 is drawn by the first fast expansion component p1*b* after the pressure generating chamber 35 is drawn by the first slow expansion component p1*a*. The ejection driving pulse DP' is also different from the ejection driving pulse DP according to the first embodiment in that the second pressure generating chamber expansion component p5 is provided with no mid hold component p5*b* between the second fast expansion component p5 and the second slow expansion component p5*c*.

In the above-described embodiment, two change ratios are used for the first pressure generating chamber expansion component p1 and the second pressure generating chamber expansion component p5. However, the invention is not limited thereto, but three or more change ratios may be used.

In the above-described embodiment, the so-called longitudinal vibration mode piezoelectric vibrator 20 has been exemplified as a pressure generating element, but the invention is not limited thereto. For example, a so-called bending vibration mode piezoelectric vibration may be used. In this case, in the exemplified driving signal, a waveform reversed in a potential change direction, that is, a vertical direction is used.

As for the shape of the nozzle, in the above-described embodiment, the nozzle includes the straight portion 37*a* of which the inner diameter is constant and the taper portion 37*b* of which the inner diameter increases toward the side of the pressure generating chamber 35. However, the invention is not limited thereto. A nozzle may be used which has a cross-section area on the pressure generating chamber side which increases more than that on the liquid ejection side.

The invention is not limited to the printer, as long as it is a liquid ejecting apparatus capable of controlling ejection by use of a plurality of driving signals. That is, the invention is applicable to a variety of ink jet printing apparatuses such as a plotter, a facsimile apparatus, and a copy apparatus. Moreover, the invention is applicable to a liquid ejecting apparatus, such as a display manufacturing apparatus, an electrode manufacturing apparatus, and a chip manufacturing apparatus, other than the printing apparatus.

The entire disclosure of Japanese Patent Application No. 2009-017486, filed Jan. 29, 2009 is expressly incorporated by reference herein.

What is claimed is:

1. A liquid ejecting apparatus comprising:

a liquid ejecting head which includes nozzles, pressure generating chambers communicating with the nozzles, and pressure generating elements causing a pressure change in a liquid of the pressure generating chambers and which ejects the liquid from the nozzles in response to an operation of the pressure generating elements; and a driving signal generating unit which drives the pressure generating elements to repeatedly generate a driving signal containing an ejection driving pulse used to eject the liquid from the nozzles, wherein the ejection driving pulse has a pulse waveform containing a first pressure generating chamber expansion component which expands the pressure generating chamber to draw a meniscus toward the pressure generating chamber side, a pressure generating chamber contraction component which contracts the pressure generating chamber expanded by the first pressure generating chamber expansion component to push the meniscus toward the liquid ejection side, and a second pressure generating chamber expansion component which expands the pressure generating chamber contracted by the pressure generating chamber contraction component to draw the meniscus toward the pressure generating chamber side again, and wherein each of the pressure generating chamber expansion components has a plurality of different potential change ratios.

2. The liquid ejecting apparatus according to claim 1, wherein the first pressure generating chamber expansion component includes at least a first fast expansion component in which a potential is changed at a first change ratio and a first slow expansion component which occurs before the first fast expansion component and in which the potential is changed at a second change ratio smaller than the first change ratio.

3. The liquid ejecting apparatus according to claim 1, wherein the second pressure generating chamber expansion component includes at least a second fast expansion component in which a potential is changed at a third change ratio and a second slow expansion component which occurs after the second fast expansion component and in which the potential is changed at a fourth change ratio smaller than the third change ratio.

4. The liquid ejecting apparatus according to claim 3, wherein the second pressure generating chamber expansion component includes an expansion hold component, which holds the expanded state of the pressure generating chamber expanded by the second fast expansion component during a certain period, between the second fast expansion component and the second slow expansion component, and wherein the expansion hold component holds the expanded state of the pressure generating chamber, until a movement direction of the meniscus on the inner circumferential surface of the nozzle is reversed from the pressure generating chamber side to the liquid ejection side after the expansion of the pressure generating chamber by the second fast expansion component.

5. A method of controlling a liquid ejecting apparatus including a liquid ejecting head which includes nozzles, pressure generating chambers communicating with the nozzles, and pressure generating elements causing a pressure change in a liquid of the pressure generating chambers and which ejects the liquid from the nozzles in response to an operation of the pressure generating elements and a driving signal generating unit which drives the pressure generating elements to repeatedly generate a driving signal containing an ejection driving pulse used to eject the liquid from the nozzles, the method comprising:

an ejection process executed by applying the ejection driving pulse to the pressure generating element, wherein the ejection process includes a first pressure generating chamber expansion step of expanding the pressure generating chamber to draw a meniscus toward the pressure generating chamber side, a pressure generating chamber contraction step of contracting the pressure generating chamber to push the meniscus toward the liquid ejection side, and a second pressure generating chamber expansion step of expanding the pressure generating chamber to draw the meniscus toward the pressure generating chamber side again, and wherein in each of the pressure generating chamber expansion steps, an expansion ratio is changed during the expansion.

6. The method according to claim 5, wherein in the first pressure generating chamber expansion step, an expansion speed of a first slow expansion step executed earlier is smaller than an expansion speed of a first fast expansion step executed later.

7. The method according to claim 5, wherein in the second pressure generating chamber expansion step, an expansion speed of a second fast expansion step executed earlier is larger than an expansion speed of a second slow expansion step executed later.

* * * * *